US007101250B2

(12) United States Patent
Lam et al.

(10) Patent No.: US 7,101,250 B2
(45) Date of Patent: Sep. 5, 2006

(54) CHANNEL SELECTOR FOR SELECTING AN OPERATING FREQUENCY

(75) Inventors: Man Tai Vincent Lam, Hong Kong (HK); Man Lung Lam, Hong Kong (KH); Sze Ming Patrick Kwong, Hong Kong (HK)

(73) Assignee: Radioshack Corporation, Fort Worth, TX (US)

( * ) Notice: Subject to any disclaimer, the term of this patent is extended or adjusted under 35 U.S.C. 154(b) by 322 days.

(21) Appl. No.: 10/611,045

(22) Filed: Jul. 1, 2003

(65) Prior Publication Data

US 2005/0003734 A1 Jan. 6, 2005

(51) Int. Cl.
*A63H 30/04* (2006.01)
*A63H 17/00* (2006.01)

(52) U.S. Cl. ..... 446/456; 446/454

(58) Field of Classification Search ..... 446/454–456; 463/36–39, 43, 62–63
See application file for complete search history.

(56) References Cited

U.S. PATENT DOCUMENTS

| | | | | |
|---|---|---|---|---|
| 4,219,962 | A | 9/1980 | Dankman et al. | |
| 4,563,626 | A | 1/1986 | Ohtake | |
| 4,938,483 | A * | 7/1990 | Yavetz | 463/5 |
| 5,127,658 | A | 7/1992 | Openiano | |
| 5,334,075 | A | 8/1994 | Kakizaki et al. | |
| 5,334,076 | A | 8/1994 | Shinozuka | |
| 5,499,388 | A * | 3/1996 | Song | 455/62 |
| 5,885,159 | A * | 3/1999 | DeAngelis | 463/39 |
| 6,011,489 | A * | 1/2000 | Ki Kwan et al. | 340/825.72 |
| 6,014,597 | A | 1/2000 | Kochanneck | |
| 6,705,873 | B1 * | 3/2004 | Higashida | 434/393 |
| 6,759,961 | B1 * | 7/2004 | Fitzgerald et al. | 340/573.1 |
| 6,821,148 | B1 * | 11/2004 | Puettner et al. | 439/587 |
| 6,907,029 | B1 * | 6/2005 | Brabrand | 370/347 |
| 6,910,939 | B1 * | 6/2005 | Hui | 446/93 |
| 6,913,507 | B1 * | 7/2005 | Hui | 446/429 |
| 2001/0045978 | A1 * | 11/2001 | McConnell et al. | 348/42 |
| 2002/0163905 | A1 | 11/2002 | Brabrand | |
| 2003/0148703 | A1 * | 8/2003 | Scott et al. | 446/456 |
| 2005/0003735 | A1 * | 1/2005 | Carter et al. | 446/456 |

OTHER PUBLICATIONS

Patent Cooperation Treaty—U.S. Patent Office, "Notification of Transmittal of the International Search Report and the Written Opinion of the International Searching Authority, or the Declaration," International Application No. PCT/US2004/21089, Sep. 9, 2005, 11 pages.

* cited by examiner

*Primary Examiner*—Xuan M. Thai
*Assistant Examiner*—Alex F.R.P. Rada, II
(74) *Attorney, Agent, or Firm*—Haynes and Boone, LLP

(57) ABSTRACT

Provided is a transmitter that includes a channel selector for modifying an operating frequency of a radio-controlled toy. The transmitter has a channel selection switch that enables a user to pick a channel from a set of predefined channels. The selected channel is then transferred to the toy. For example, a microcontroller unit within the transmitter may be used to detect the selected channel. The toy is placed in contact with the transmitter and the transmitter's microcontroller unit communicates the channel to a microcontroller unit inside the toy. The toy's microcontroller stores the channel in a memory in the toy. The toy then tunes to the stored frequency to receive control signals from the transmitter.

20 Claims, 8 Drawing Sheets

12
18
14
22
16
22
10
96
110
112
106
100
92
90
108
114
CH+
PROG
CH-
104
102
86
94
20
116
38
32
42
30
Left Right
50
84
122
118
36
52
68
26
120
70
POWER
34
72
48
CHANNEL
28
54
40
78
82
46
80
44
24
76

FORWARD/BACKWARD CONTROL

LEFT/RIGHT STEERING

Fig. 5E CHARGING CIRCUIT

MOTOR CONTROL CIRCUIT 1

MOTOR CONTROL CIRCUIT 2

DC-DC CONVERTER

CHANNEL SELECTOR FOR SELECTING AN OPERATING FREQUENCY

CROSS-REFERENCE TO RELATED APPLICATIONS

This invention is related to U.S. patent application Ser. No. 10/611,046, entitled "Transmitter Adaptable for Left-Handed or Right-Handed Use" (Inventors: Joel Carter, Bill Yeung, and Chan Yeung) and U.S. patent application Ser. No. 29/185,632, entitled "Radio Frequency Toy Controller Design" (Inventor: Chan Yeung), both of which were filed on the same day as the present application.

BACKGROUND

This disclosure relates generally to radio-controlled mobile toys and, more specifically, to selecting an operating frequency in such toys.

A radio-controlled toy, such as a radio-controlled car, is generally operated by a transmitter that transmits radio signals to the radio-controlled car using a predefined frequency (e.g., a channel). Because the radio-controlled car needs to be able to receive the radio signals transmitted by the transmitter, both the transmitter and the radio-controlled car should be set to a common frequency (e.g., should use the same channel).

Current methods for setting the frequency of the transmitter and the radio-controlled car include the use of crystals or radio frequency (RF) modules, which typically have a predetermined frequency. Accordingly, in order to operate the radio-controlled car via another frequency, the crystals or RF modules in both the transmitter and radio-controlled car must be replaced with new ones of the desired frequency, which can be both time-consuming and expensive.

Therefore, what is needed is a transmitter having a channel selector for selecting an operating frequency of the transmitter and an associated radio-controlled toy.

SUMMARY

Provided is a channel selector for selecting an operating frequency. In one embodiment, a transmitter is provided for enabling the selection of one of a plurality of predefined channels for use in communicating with a radio-controlled toy. The transmitter includes a selector for selecting one of the plurality of channels, a detector for identifying the selected channel, and an interface for transferring the identified channel from the transmitter to the toy.

In another embodiment, a programmable frequency radio-controlled car is provided. The radio-controlled car includes an interface for receiving a user-selected operating frequency from a transmitter, a controller for detecting the received operating frequency; and a memory accessible to the controller for storing the received operating frequency. The stored operating frequency is used by the radio-controlled car for interpreting signals transmitted by the transmitter.

In yet another embodiment, a system for selecting an operating frequency is provided for communication between a radio transmitter and a radio-controlled toy. The radio transmitter of the system includes a frequency selector for selecting the operating frequency from a plurality of frequencies and an interface for transferring the selected operating frequency to the radio-controlled toy. The radio-controlled toy of the system includes an interface for receiving the selected operating frequency from the radio transmitter and a memory accessible to the interface for storing the received operating frequency.

In yet another embodiment, a transmitter for a radio-controlled toy having a programming contact and at least two charging contacts is provided. The transmitter includes a housing, a frequency selection circuit positioned within the housing, a charging circuit positioned within the housing, an interface pad proximate to a surface of the housing, and a channel selection switch on the housing for selecting one of a plurality of predefined frequencies for the transmitter and the toy. The interface pad provides electrical communication between the frequency selection circuit and the programming contact of the toy to transfer frequency selection information from the frequency selection circuit to the toy. The interface pad further provides electrical communication between the charging circuit and the charging contacts of the toy. The selected frequency is set as an operating frequency of the transmitter and toy during charging of the toy, and the operating frequency is used for communications between the transmitter and toy.

BRIEF DESCRIPTION OF THE DRAWINGS

FIG. 5E is an exemplary circuit diagram of a charging circuit located in the transmitter of FIG. 1.

DETAILED DESCRIPTION

Figure 1:
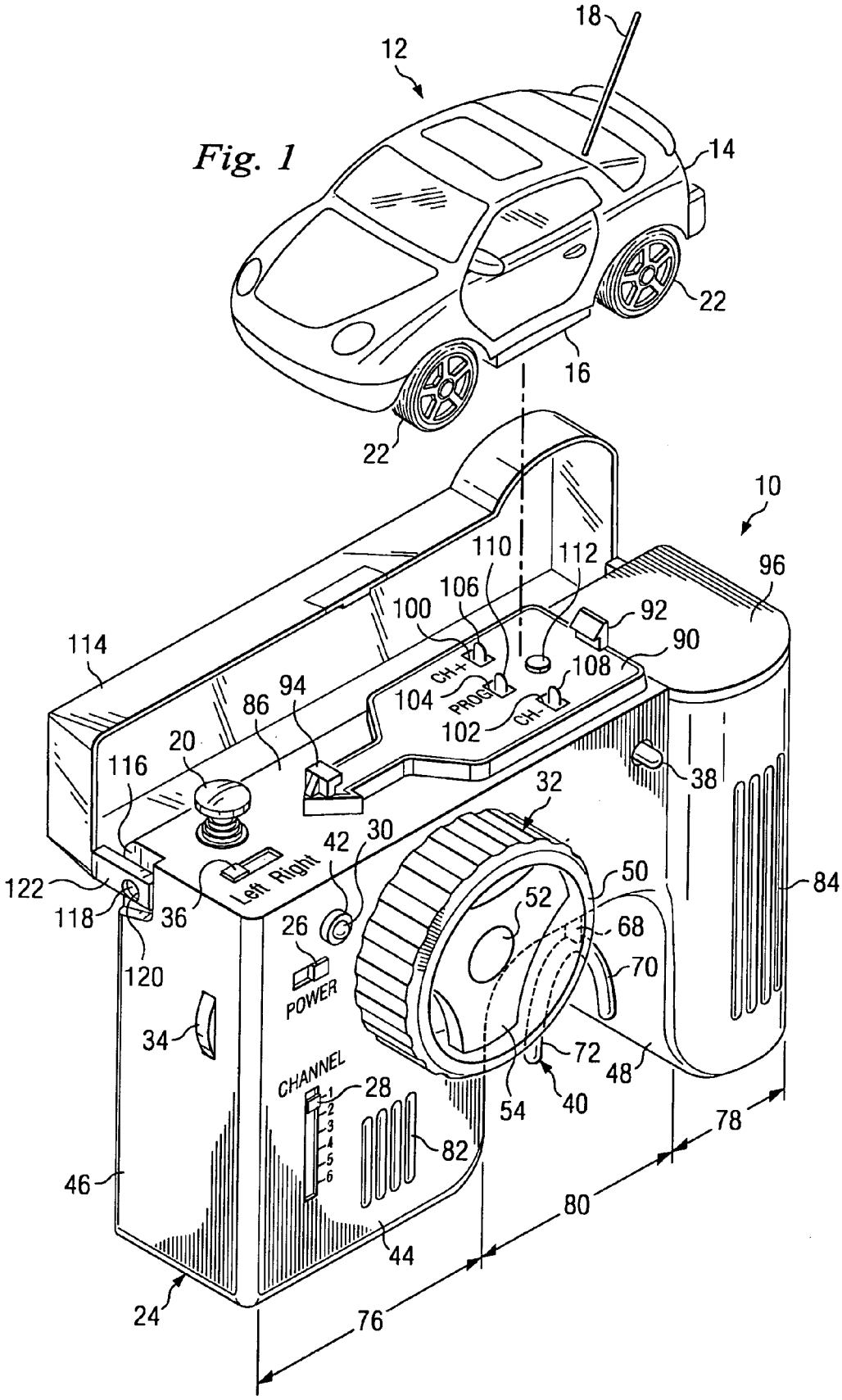
FIG. 1 is a perspective view of a transmitter and a radio-controlled car according to one embodiment of the present disclosure.

This disclosure relates generally to radio-controlled mobile toys and, more specifically, to selecting an operating frequency in such toys. It is understood, however, that the following disclosure provides many different embodiments or examples. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
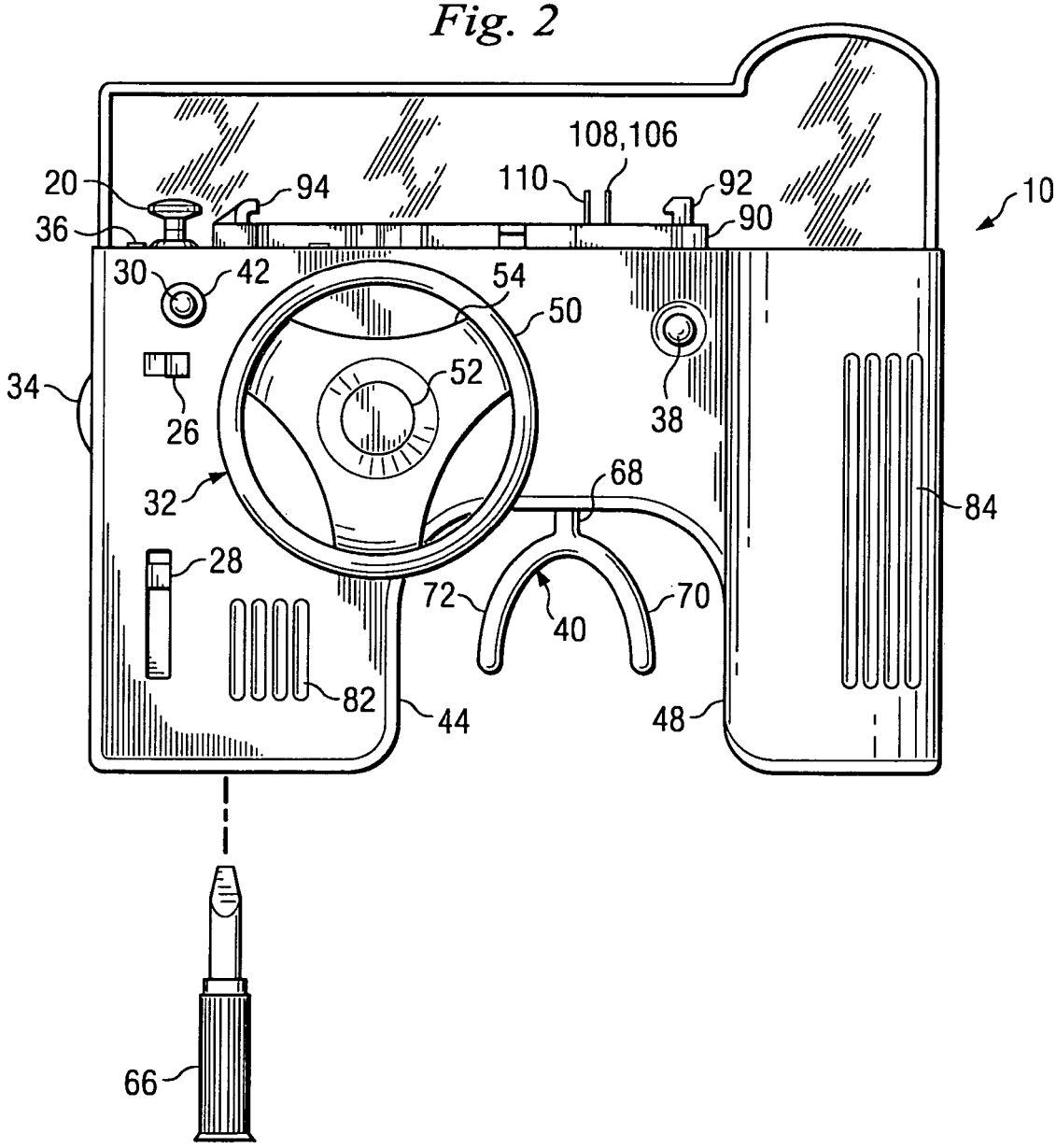
FIG. 2 is a front view of the transmitter of FIG. 1.
Figure 3:
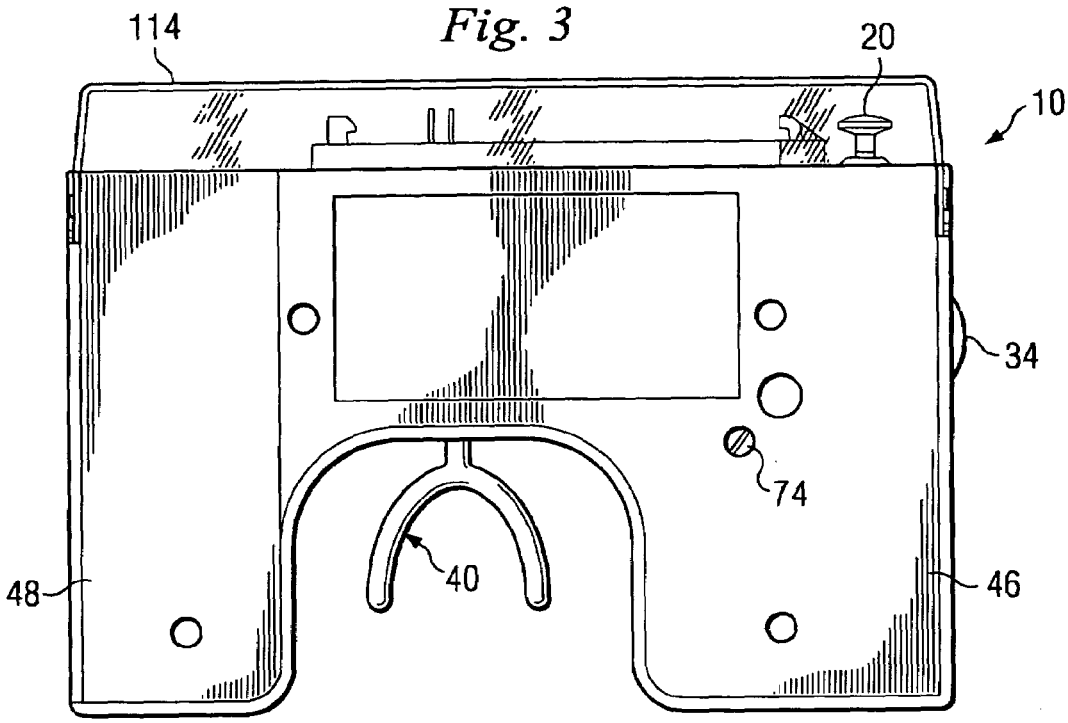
FIG. 3 is a rear view of the transmitter of FIG. 1.

Referring to FIGS. 1–3, in one embodiment, a transmitter 10 may be used to control a radio-controlled toy 12. For purposes of example, the radio-controlled toy 12 is a radio-controlled car that includes a body 14 and a chassis 16. The body 14 may connect to the chassis 16 in a variety of ways, including a conventional pressure fit or a snap connection. Accordingly, various configurations of the body 14 may be used with the chassis 16. The radio-controlled car 12 further includes a set of wheels 22 associated with the chassis 16.

A plurality of electronic circuits (FIGS. 5A–6D) are housed within the transmitter 10 and the radio-controlled car 12. As will be described later in greater detail, the circuits enable interaction between the transmitter 10 and the radio-controlled car 12 so that the radio-controlled car 12 may be controlled via the transmitter 10. An antenna 18 may be provided on the radio-controlled car 12 to receive radio signals from an antenna 20 of the transmitter 10.

The transmitter 10 includes a housing 24 for enclosing the circuits. A user may interact with the circuits using a plurality of control devices disposed on the transmitter 10. These control devices may include a power switch 26, a channel selection switch 28, an indicator 30, a steering member 32, a steering adjuster 34, a left hand/right hand selection switch 36, a release button 38, and a motion control member 40. It is understood that the number, type, and arrangement of control devices on the transmitter 10 illustrated in FIGS. 1–3 are for purposes of example, and that alternate numbers and/or types of control devices may be provided. For example, the channel selection switch 28 may be any user input means, including but not limited to a rotatable knob, or a voice-recognition circuit. An indicator housing 42 may be used to protect the indicator 30.

As illustrated, in the present example, the power switch 26, the channel selection switch 28, the indicator 30, the steering member 32, and the release button 38 are provided on a front surface 44 of the transmitter 10, while the steering adjuster 34 is provided on a side 46 of the transmitter 10, and the left hand/right hand selection switch 36 is provided on a top surface 86 of the transmitter. Furthermore, the motion control member 40 extends from the transmitter 10 into a cutout 48 formed through the transmitter 10.

The steering member 32 and the motion control member 40 enable the movement of the radio-controlled car 12 to be controlled. The steering member 32 may include an annular portion 50, which is radially spaced from a central portion 52. The central portion 52 is the portion of the steering member 32 that extends into the housing 24 to operatively connect with a left/right steering circuit as will be described later with respect to FIG. 5C. The steering member 32 may further include a plurality of radially-extending legs 54 for connecting the annular portion 50 with the central portion 52. The steering member 32 may be removably connected to the transmitter 10 in any conventional manner, such as a snap-fit.

The steering adjuster 34 on the transmitter 10 may be used to ensure proper wheel alignment (e.g., to correct "drift") in the steering of the radio-controlled car 12. For example, if the transmitter 10 is directing the radio-controlled car 12 to drive in a straight line, but the radio-controlled car 12 is veering to the right, the steering alignment may be adjusted via the steering adjuster 34 so that the radio-controlled car 12 proceeds in a straight line as directed.

In the present example, the steering adjuster 34 is a wheel, which is initially in a neutral position. Rotating the steering adjuster 34 adjusts the signal that is transmitted by the transmitter 10 to the radio-controlled car 12. For example, if the transmitter 10 transmits instructions to the radio-controlled car 12 using a series of pulses (e.g., pulse modulation), then the steering adjuster 34 may be rotated to a non-neutral position to alter the transmitted pulses so that they represent a neutral state. For example, a potentiometer responsive to the rotation of the steering adjuster 34 may be used to alter a pulse width of the transmitted pulses.

The motion control member 40 may include an extension portion 68 and an inverted U-shaped portion 70. The inverted U-shaped portion 70 provides a groove 72 through which the user may insert a finger to control movement of the motion control member 40 in a substantially right or left direction. Movement of the motion control member 40 from a neutral position instructs the transmitter 10 to signal the radio-controlled car 12 to move either forward or backward. The direction of movement may be dependent on the left hand/right hand selection switch 36, as will be described further with respect to the operation of the radio-controlled car 12 and a left hand/right hand selection circuit of FIG. 5A.

The transmitter 10 may also include a motion control trimmer 74 (FIG. 3), which may be adjustable via a tool 66 (FIG. 2), such as a screwdriver. In one example, the tool 66 may be housed in the transmitter 10 during nonuse as illustrated by the exploded view of the tool in FIG. 2. The motion control trimmer 74 may be used to compensate for undesired forward or backward motion of the radio-controlled car 12. For example, if the radio-controlled car 12 moves in a forward or backward direction when the motion control member 40 is in a neutral position, the motion control trimmer 74 may be adjusted so that the radio-controlled car 12 remains stationary unless the motion control member 40 is moved from its neutral position. As described previously with respect to the steering adjuster 34, the motion control trimmer 74 may operate via a potentiometer that adjusts a characteristic of the signal transmitted to the radio-controlled car 12.

Referring now to the front surface 44 of the transmitter 10, the cutout 48 generally defines a left portion 76, a right portion 78, and a middle portion 80 of the front surface. A gripping means 82 may be formed in the left portion of the front surface for providing a left-hand gripping surface for the user. The gripping means 82 may be any non-uniform surface that aids the user in gripping the transmitter 10. For example, the gripping means 82 may be a plurality of channels formed in the transmitter. The right portion 78 of the front surface 44 protrudes relative to the left portion 76 and is generally curved to provide a right-hand gripping surface for the user. A gripping means 84 may be formed in the right portion 78 of the front surface 44 to further aid in providing the right-hand gripping surface.

Referring now to the top surface 86 of the transmitter 10, an interface pad 90 is adapted to couple the radio-controlled car 12 to the transmitter 10 during selection of an operating frequency and charging of a battery (not shown) housed within the radio-controlled car 12. It is understood that selection of the operating frequency and charging of the battery may be accomplished independently of one another. For example, the operating frequency of the car 12 may be changed even if the car is fully charged. It is further understood that changing of the frequency may be accomplished using alternate interfaces such as via an infrared port or wirelessly using a radio frequency. For example, if the frequency is changed wirelessly using a radio frequency, the transmitter 10 and the car 12 may each include a memory or timer for monitoring a defined amount of time. At the end of the defined amount of time, the transmitter 10 and the car 12 will simultaneously switch over to the new frequency.

In the present example, a pair of catches 92 and 94 extend through the interface pad 90 to couple the chassis 16 of the radio-controlled car 12 to the interface pad 90 during charging. The catches 92 and 94 may also aid in aligning the radio-controlled car 12 on the interface pad 90. The release button 38 is operatively connected to the catches 92 and 94, such that depression of the release button 38 releases the radio-controlled car 12 from the interface pad 90. A portion of the top surface 86 of the transmitter 10 may be formed as a removable cover 96 for providing access to a battery housing (not shown) disposed within the transmitter.

A plurality of slots 100, 102, and 104 are formed in the interface pad 90 to provide external access to a pair of electrical charging contacts 106 and 108 and an electrical programming contact 110, respectively. It is understood that the orientation of contacts extending from the transmitter 10 is variable, and that additional contacts may be used. A charging button 112 may be further provided through the interface pad 90 for contacting the chassis 16, as will be described later with respect to the operation of the radio-controlled car 12 and a charging circuit of FIG. 5E.

A cover 114 may be used to enclose and protect the interface pad 90 and the antenna 20 during nonuse. The housing 24 includes a step-down portion 116 for accommodating movement of the cover 114 from an open position to a closed position. A protrusion 118 extends from the step-down portion 116 for receiving a corresponding bore 120 formed through a flange 122 of the cover 114 for connecting the cover to the housing 24.

Figure 4:
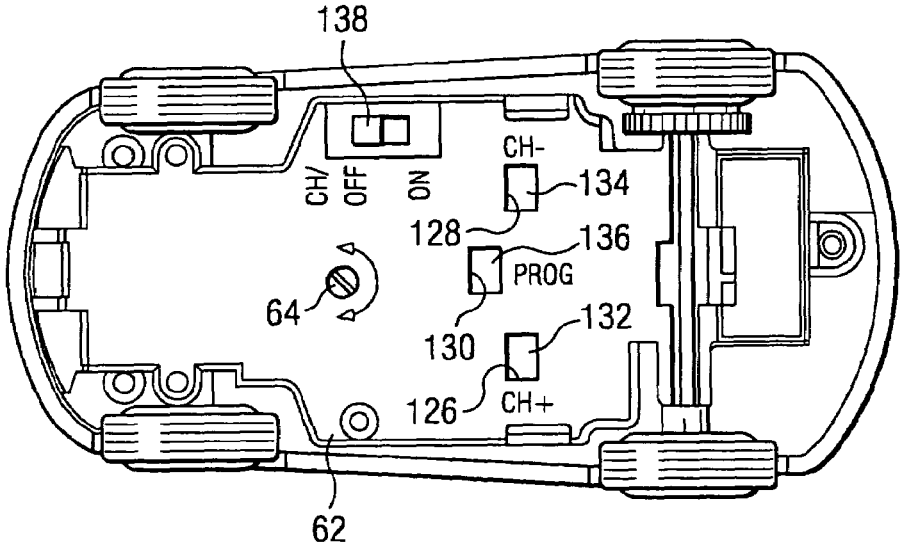
FIG. 4 is a bottom view of the radio-controlled car of FIG. 1.

Referring now to FIG. 4, a bottom surface 62 of the chassis 16 may include a steering trimmer 64. Like the steering adjuster 34 of the transmitter 10, the steering trimmer 64 may be used to ensure proper wheel alignment in the steering of the radio-controlled car 12. For example, if the transmitter 10 is directing the radio-controlled car 12 to drive in a straight line, but the radio-controlled car 12 is veering to the right, then the steering alignment may be adjusted via the steering trimmer 64 so that the radio-controlled car 12 proceeds in a straight line as directed. Although the steering adjuster 34 and steering trimmer 64 may be used separately, it is understood that they may enable a larger adjustment to be made to the steering alignment when used together.

In the present example, the steering trimmer 64 is initially in a neutral position. Rotating the steering trimmer 64 adjusts the way in which the radio-controlled car 12 responds to the signal that is received from the transmitter 10. For example, if the transmitter 10 transmits instructions to the radio-controlled car 12 using a series of pulses (e.g., pulse modulation), then the steering trimmer 64 may be rotated to a non-neutral position (either by hand or using a tool such as the screwdriver 66) to alter the received pulses so that they represent a neutral state. For example, a potentiometer responsive to the rotation of the steering trimmer 64 may be used to alter a pulse width of the transmitted pulses.

A plurality of slots 126, 128, and 130 are formed through the bottom surface 62 of the chassis 16 for allowing access to a pair of electrical charging contacts 132 and 134 and an electrical programming contact 136. The charging contacts 132 and 134 and the programming contact 136 of the car 12 correspond to the charging contacts 106 and 108 and the programming contact 110, respectively, of the transmitter 10. It is understood that the transmitter 10 and the car 12 may be connected for purposes of charging and programming by other means such as cables that connect into jacks associated with the transmitter and the car. A power switch 138 may further be provided on the bottom surface 62 of the chassis 16. Accordingly, when the radio-controlled car 12 is placed onto the interface pad 90 of the transmitter 10, circuits within the radio-controlled car 12 may electrically connect with corresponding circuits within the transmitter 10. Additionally, although not shown, the car 12 may include an indicator for indicating various operating states of the car, such as the operating frequency. The indicator on the car 12 may be provided in addition to, or in place of, the indicator 30 of FIG. 1.

Referring now to FIGS. 5A–5F, a plurality of circuits that may be housed within the transmitter 10 are illustrated. It is understood that relationships may exist between various circuits and/or circuit components of FIGS. 5A–5F. For example, the circuit of FIG. 5A includes a microcontroller unit (MCU) denoted by the reference number U203. The MCU U203 includes various input and output ports, including a POWER_LED output and a CHA_LED output. The POWER_LED and CHA_LED outputs serve as inputs to the LED circuit of FIG. 5F.

Figure 5A:
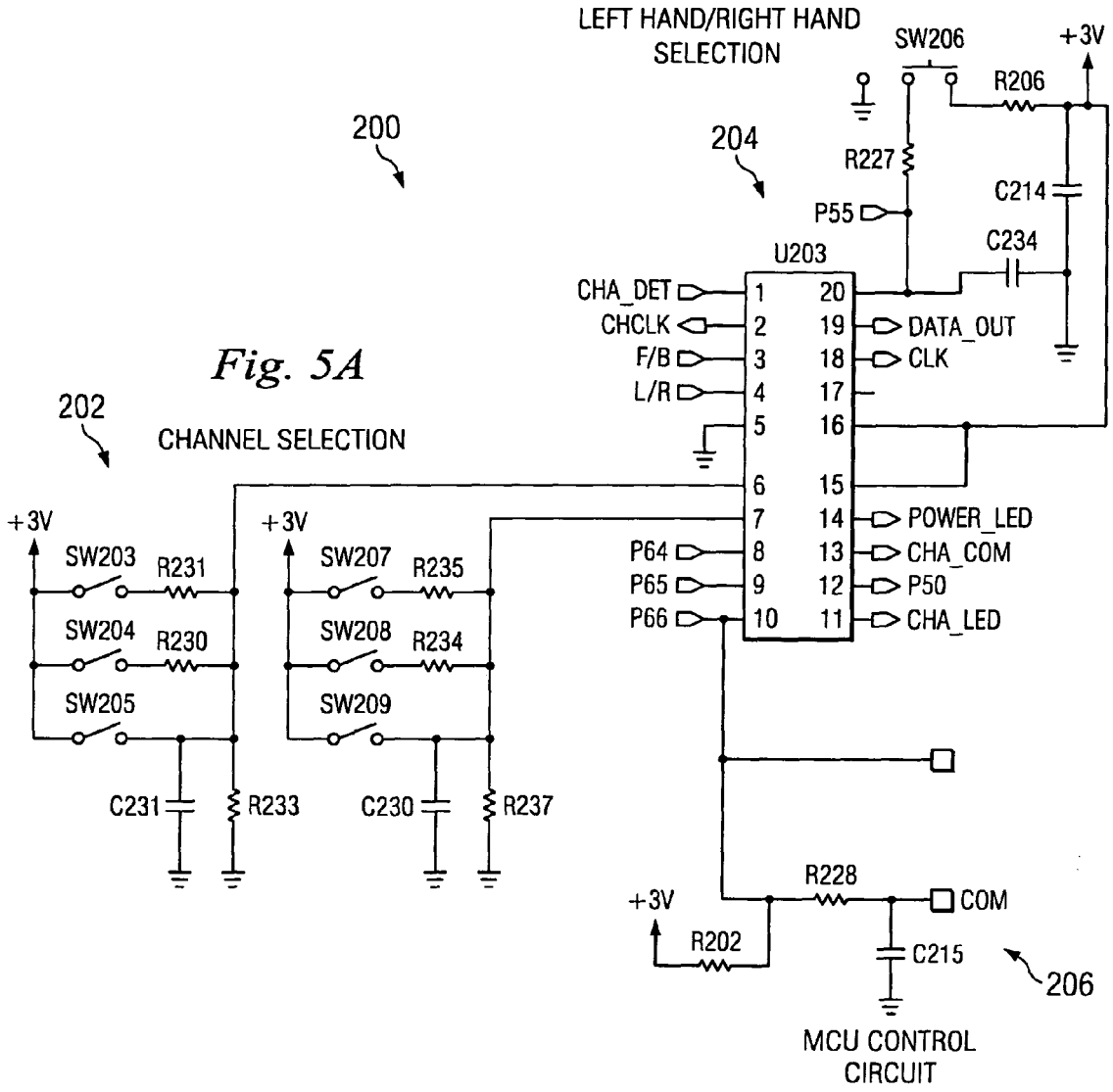
FIG. 5A is an exemplary circuit diagram for the transmitter of FIG. 1 illustrating a channel selection circuit, a left hand/right hand selection circuit, and a control circuit for a microcontroller unit.

Referring now to FIG. 5A, a circuit 200 includes the MCU U203, a channel selection circuit 202, a left hand/right hand selection circuit 204, and a MCU control circuit 206. For purposes of example, the MCU U203 is an EM78458, made by Elan Microelectronics, with 4K of read only memory (ROM). The memory of the MCU U203 includes a plurality of instructions for controlling various aspects of the transmitter 10. For example, in conjunction with various circuits, the MCU U203 may program a selected frequency of the radio-controlled car 12, handle charging, control steering and left/right and front/back motion, and perform other tasks.

The channel selection circuit 202 is associated with the channel selection switch 28 of FIG. 1 through switches SW203–SW205 and SW207–SW209, each of which corresponds to a channel 1–6 of the channel selection switch 28. It is understood that any number of channels are contemplated. In the present example, only one of the switches SW203–SW205 and SW207–SW209 can be in a closed state (e.g., if channel 1 is selected, SW203 may be closed, while SW204, SW 205, SW207-SW209 may be open). The state of the switches (e.g., open or closed) may be read by the MCU U203 as a voltage through an analog to digital converter that is contained within the MCU U203. This state informs the MCU U203 of the user-selected channel that is to be used by the transmitter 10 and the radio-controlled car 12. After the selected channel is confirmed by comparison of the read voltage to a predefined value within the MCU U203, the MCU U203 may program an integrated circuit (e.g., IC U201 of FIG. 5D) through a CHCLK signal pin. This sets the transmitter 10 to transmit signals using the selected channel.

The MCU U203 may then transfer information regarding the user-defined channel to an MCU U2 (FIG. 6A) within the radio-controlled car 12 via the programming contact 110. In the present example, channel programming of the radio-controlled car 12 may be accomplished when the radio-controlled car 12 is placed onto the interface pad 90. In some embodiments, the programming may occur in a predefined period of time, such as during the first eight seconds of a charging cycle. For example, if a user desires to change the channel from 3 to 4, he may push the channel selection switch 28 one step upwards. This changes the input voltage at pins 6 and 7 of the MCU U203, and the MCU U203 detects the selection of channel 4 by comparing the detected voltage level with an internal threshold level. The MCU U203 then sets the transmitter 10 to transmit using the selected channel and transfers the selected channel to the radio-controlled car 12.

Figure 5B:
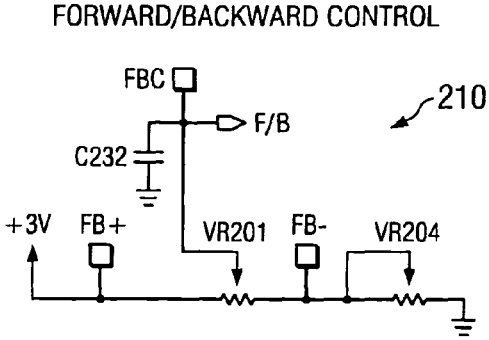
FIG. 5B is an exemplary circuit diagram for the transmitter of FIG. 1 illustrating a forward/backward motion control circuit.

The left hand/right hand selection circuit 204 is associated with the left hand/right hand selection switch 36 of FIG. 1 through a switch SW206. In the present example, moving the left hand/right hand selection switch 36 on the transmitter 10 from right hand to left hand (or vice versa) reverses the operation of the motion control member 40 by reversing an FB+ contact and a FB− contact (FIG. 5B). This enables the transmitter 10 to be adjusted for use with both right and left-handed users.

Figure 5C:
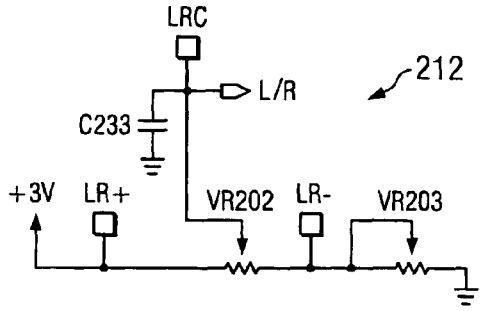
FIG. 5C is an exemplary circuit diagram for the transmitter of FIG. 1 illustrating a left/right steering circuit.
Figure 5D:
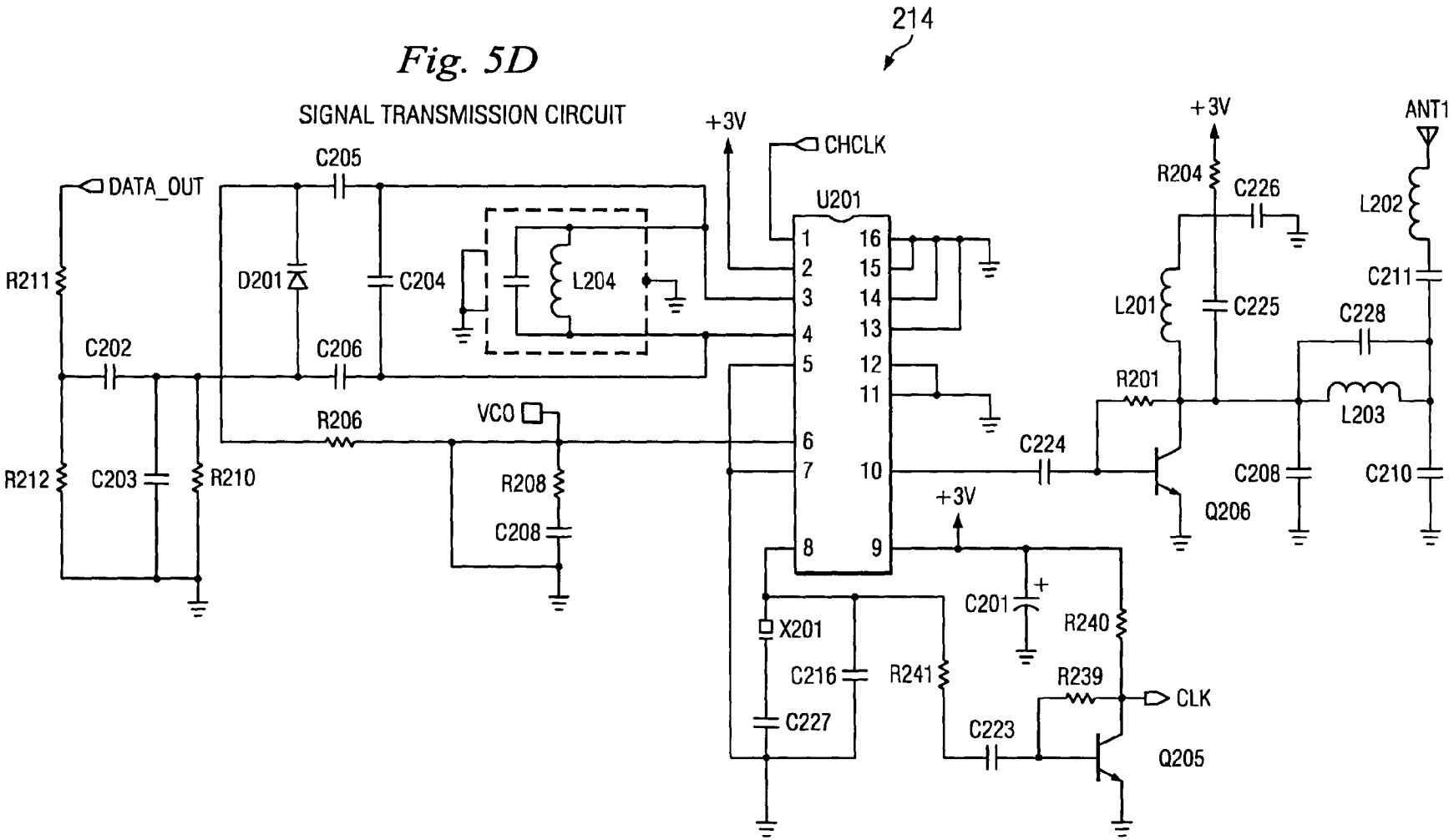
FIG. 5D is an exemplary circuit diagram of a signal transmission circuit located in the transmitter of FIG. 1.
Figures 5F, 5G, 5H:
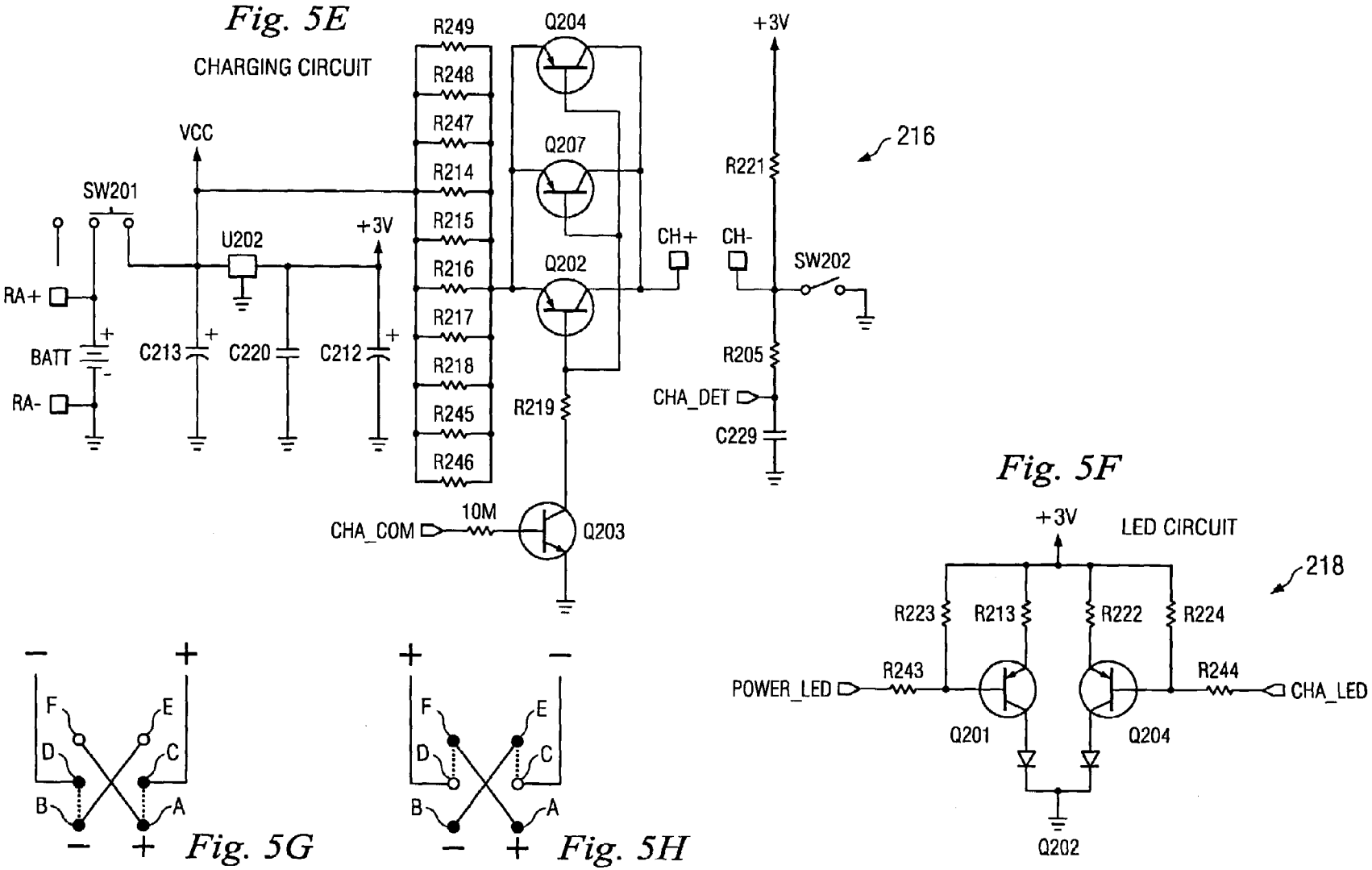
FIG. 5F is an exemplary circuit diagram of a light emitting diode (LED) circuit located in the transmitter of FIG. 1.
FIG. 5G is a diagram illustrating a first position of an exemplary left hand/right hand selection switch associated with the transmitter of FIG. 1.
FIG. 5H is a diagram illustrating a second position of the exemplary left hand/right hand selection switch of FIG. 5G.

With additional reference to FIGS. 5G and 5H, one embodiment of the left hand/right hand selection switch 36 (and the corresponding switch SW206 of FIG. 5A) is associated with six contact points A–F. The contact A is of positive polarity and the contact B is of negative polarity. Contact A is connected to contact F, and contact B is connected to contact E. For purposes of illustration, contact C is connected to the FB+ contact (FIG. 5B) and contact D is connected to the FB− contact (FIG. 5B).

When the switch SW206 is set for right-handed use (FIG. 5G), the contacts A and C are connected, and the contacts B and D are connected. This gives the contact C (and the associated contact FB+) a positive polarity, and gives the contact D (and the associated contact FB−) a negative polarity. When the switch SW206 is set for left-handed use (FIG. 5H), the contacts C and E are connected, and the contacts D and F are connected. This reverses the polarity of the contacts C and D, giving the contact C (and the associated contact FB+) a negative polarity, and giving the contact D (and the associated contact FB−) a positive polarity. Accordingly, by manipulating the polarity of the FB+ and FB− contacts via the contacts A–F, the transmitter 10 may be set for right-handed or left-handed use.

Referring now to FIG. 5B, a forward/backward motion control circuit 210 housed within the transmitter 10 is associated with the motion control member 40 (FIG. 1) through an input FBC. Movement of the motion control member 40 affects variable resistor VR201, which may be a potentiometer, as described previously. The output voltage F/B of the forward/backward motion control circuit 210 is read by the MCU U203 (FIG. 5A) on pin 3, and the MCU U203 determines what digital signals to send to the radio-controlled car 12 based on the read voltage. As described previously, the transmitter 10 may include a motion control trimmer 74 (FIG. 3) that can be used to offset undesired forward or backward motion when the radio-controlled car 12 is supposed to remain stationary. In the present example, the motion control trimmer 74 is associated with a variable resistor VR204.

Referring now to FIG. 5C, a left/right steering control circuit 212 housed within the transmitter 10 is associated with the steering member 32 (FIG. 1) through an input LRC. Movement of the steering member 32 affects variable resistor VR202, which may be a potentiometer, as described previously. The output voltage L/R of the left/right steering circuit 212 is read by the MCU U203 (FIG. 5A) on pin 4, and the MCU U203 determines what digital signals to send to the radio-controlled car 12 based on the read voltage. As described previously, the transmitter 10 may include a steering adjuster 34 (FIG. 1) that can be used to offset undesired drift in the wheel alignment of the radio-controlled car 12. In the present example, the steering adjuster 34 is associated with variable resistor VR203.

Referring now to FIG. 5D, a signal transmission circuit 214 housed within the transmitter 10 is used to transmit control signals from the transmitter 10 to the radio-controlled car 12. The signal transmission circuit 214 includes a transistor Q206, a varactor diode D201, an antenna ANTI (which may be the antenna 20 of FIG. 1), a crystal X201, and an integrated circuit (IC) U201, which may be an ET13X221, made by Etoms Electronics. Although not shown in FIG. 5D, the IC U201 includes a phase lock loop circuit, a voltage controlled oscillator, and a crystal oscillator. In the present example, the voltage controlled oscillator within the IC U201 is operated at 27 MHz by programming a frequency counter within the IC U201 via an input port CHCLK (pin 1 of the IC U201). The IC U201 has sixteen available channels.

Data is sent from the MCU U203 to the radio-controlled 12 via an output port DATA_OUT (pin 19, FIG. 5A) as follows. When a square-wave is generated by the MCU U203 on the DATA_OUT port and applied through the resistor R211, the carrier signal is frequency shift key (FSK) modulated (e.g., it enables sub-carrier modulated signaling that can be used for data transmission, where binary ones and zeroes are represented by two different frequencies that are offset from the carrier frequency). The data is then sent to the radio-controlled car 12 via the antenna ANT1.

Referring now specifically to FIG. 5E, a charging circuit 216 housed within the transmitter 10 may be used in charging the radio-controlled car 12. In the present example, the charging circuit 216 includes a power switch SW201, a charging switch SW202 and associated contact pads CH+ and CH−, each of which correspond to an element of FIG. 1. For example, the power switch SW201 may be connected to the power switch 26, the charging switch SW202 may be connected to the charging button 112, and the contact pads CH+ and CH− may correspond to the electrical charging contacts 106, 108, respectively.

In operation, the power switch 26 of the transmitter 10 is turned to "on," which actuates the power switch SW201 of the charging circuit 216, providing an electrical connection to a battery BATT. (In the present example, the power switch 138 of the radio-controlled car 12 is also turned to "on" prior to placement of the radio-controlled car 12 on the transmitter 10.) When the radio-controlled car 12 is placed onto the interface pad 90 of the transmitter 10, the charging button 112 is depressed, actuating the charging switch SW202. When the charging switch SW202 is actuated, the MCU U203 (FIG. 5A) alters the state of pin 13 and turns on transistor Q203 (which then turns on transistors Q202, Q207, and Q208). This provides power from the battery BATT to the contact pads CH+ and CH−. A timer is started within the MCU U203 to limit the amount of time that the battery of the radio-controlled car 12 is allowed to charge, thereby preventing an overcharge from occurring and damaging the battery. In the present example, the charging duration is approximately one minute and the charging rate is approximately 10 C (where C is the one hour discharge current). An IC U202 provides a regulated voltage output to the MCU control circuit 206 (FIG. 5A) and the signal transmission circuit 214 (FIG. 5D).

Referring now to FIG. 5F, a light emitting diode (LED) circuit 218 housed within the transmitter 10 powers the indicator 30 to indicate an operating state of the transmitter 10. In the present example, the indicator 30 comprises one or more LEDs that are used to represent a variety of states using one of three colors that may be blinking or steady. For example, green and steady may indicate that the transmitter 10 is powered on or in trickle charge mode; red and blinking may indicate that channel programming (of the radio-controlled car 12) is in progress; red and steady may indicate that the radio-controlled car 12 is being charged; and amber and steady may indicate that channel programming has failed. It is understood that these states are exemplary, and that other states and/or combinations may be used. These states are controlled by the MCU U203 (FIG. 5A) via a POWER_LED output (pin 14) and a CHA_LED output (pin 11).

Referring now to FIGS. 6A–6D, a plurality of circuits that may be housed within the radio-controlled car 12 are illustrated. It is understood that relationships may exist between various circuits and/or circuit components of FIGS. 6A–6D. For example, the circuit of FIG. 6A includes a MCU denoted by the reference number U2. The MCU U2 includes various input and output ports, including a W2R output and a W2L output. The W2R and W2L outputs serve as inputs to the motor control circuit of FIG. 6B.

Figure 6A:
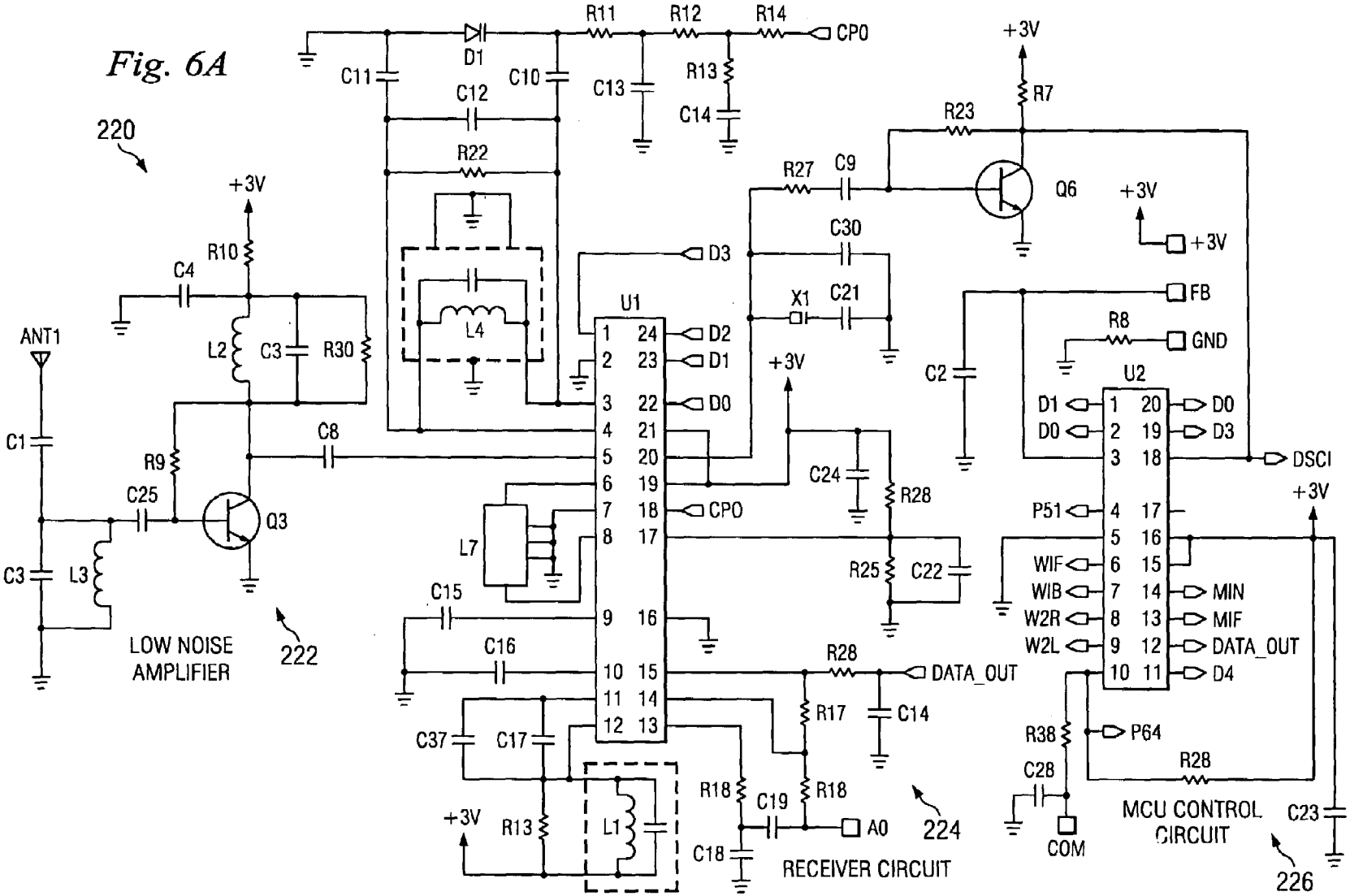
FIG. 6A is an exemplary circuit diagram for the radio-controlled car of FIG. 1 illustrating a low noise amplifier, a receiver circuit, and a control circuit for a microcontroller unit.

Referring now to FIG. 6A, a circuit 220 includes the MCU U2, an IC U1, a low noise amplifier circuit 222, a receiver circuit 224, and a MCU control circuit 226. For purposes of example, the MCU U2 may be an EM78458, made by Elan Microelectronics, and the IC U1 may be an ET13X210, made by Etoms Electronics. The MCU U2 may include a plurality of instructions for controlling various aspects of the radio-controlled car 12. For example, in conjunction with various circuits, the MCU U2 may control steering and forward/backward motion.

The channel information transferred from the MCU U203 (FIG. 5A) is received by the MCU U2. The user selected channel may be stored in memory associated with the MCU U2, which may then set the radio-controlled car 12 to receive signals using the selected channel by setting the IC U1 via pins D0–D3. In the present example, as the channel data is stored in volatile memory, it will be lost when power is lost or reset occurs, but will be reprogrammed again when the battery is charged.

The FSK modulated signal transmitted by the transmitter 10 via the antenna 20 is received by an antenna ANT2 (which may be the antenna 18 of FIG. 1) associated with the low noise amplifier circuit 222. The received signal is amplified by the low noise amplifier circuit 222 and passed to the IC U1, which mixes the signal down to an intermediate frequency. The intermediate frequency signal is then demodulated and waveform shaped to recover the original control data stream. The data stream is then decoded by the MCU U2 and used to control a first motor control circuit 228 (FIG. 6B) and a second motor control circuit 230 (FIG. 6C), which control steering of the front wheels and forward/backward motion, respectively.

Figure 6B:
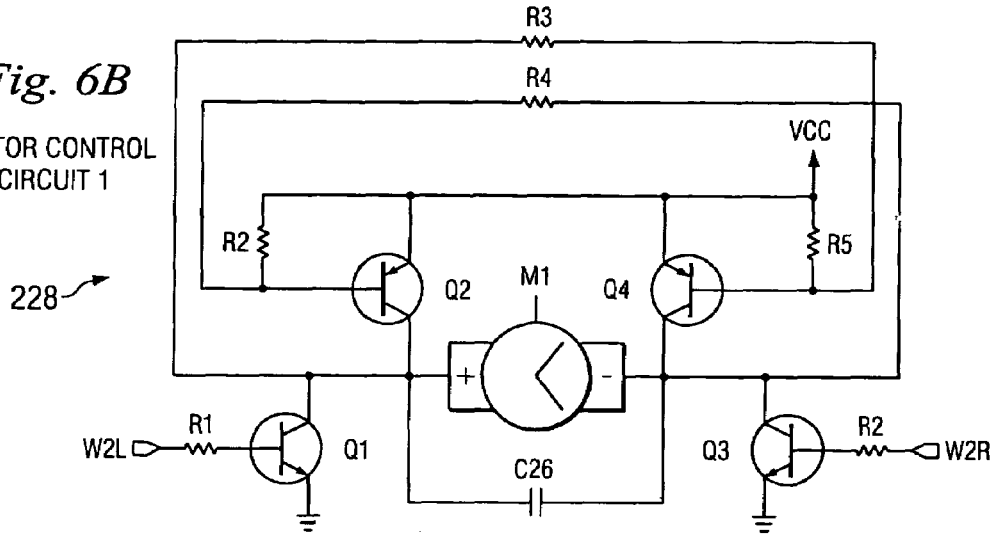
FIG. 6B is an exemplary circuit diagram of a first motor control circuit located in the radio-controlled car of FIG. 1.
Figure 6C:
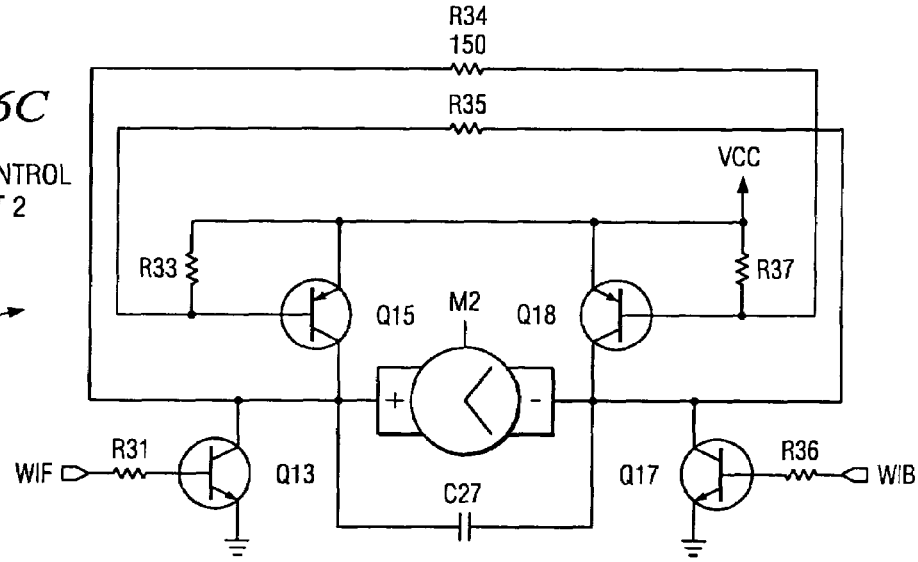
FIG. 6C is an exemplary circuit diagram of a second motor control circuit located in the radio-controlled car of FIG. 1.

More specifically, the MCU U2 controls the front wheels via two output ports W2R (pin 8) and W2L (pin 9), which correspond to circuit inputs of the same name in FIG. 6B. The steering trimmer 64 may be associated with the circuit of FIG. 6B to enable a user to manipulate the circuit in order to align the front wheels of the radio-controlled car 12. For example, the steering trimmer 64 may be associated with a variable resistor (not shown) as described previously with respect to the circuit elements VR204 and VR203 of FIGS. 5B and 5C, respectively. Similarly, the MCU U2 controls forward/backward motion via two output ports WIF (pin 6) and WIB (pin 7), which correspond to circuit inputs of the same name in FIG. 6C. Although not shown in the present example, a user-adjustable component may be associated with the circuit of FIG. 6C to enable a user to manipulate the circuit in order to adjust the forward/backward motion of the radio-controlled car 12. For example, such component may be associated with a variable resistor (not shown) as described previously.

Figure 6D:
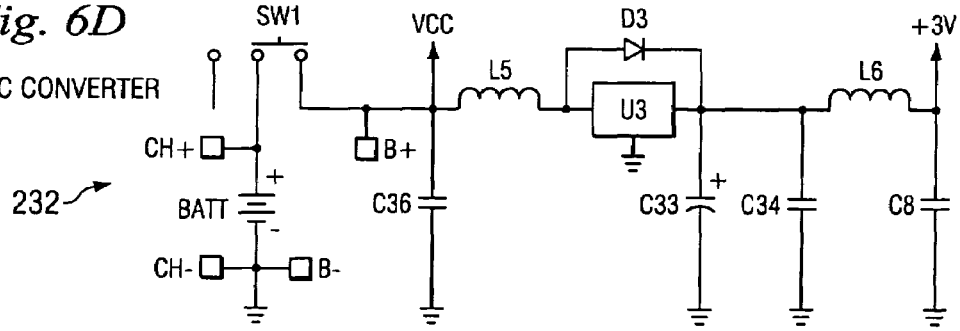
FIG. 6D is an exemplary circuit diagram of a DC—DC converter circuit located in the radio-controlled car of FIG. 1.

Referring now to FIG. 6D, a DC—DC converter circuit 232 includes a switch SWI, contact pads CH+ and CH–, and a DC—DC converter U3. The switch SW1 corresponds to the power switch 138, and the contact pads CH+ and CH– may correspond to the electrical charging contacts 132, 134 (FIG. 4), respectively. When the switch SWI is closed, power is provided to the circuit 232. The DC—DC converter U3 steps the battery voltage up from 2.4V to 3V.

To operate the radio-controlled car 12, a user turns both the power switch 26 of the transmitter 10 and the power switch 138 of the radio-controlled car 12 to "on." The indicator 30 may emit a green color to indicate that the transmitter 10 is on. If the battery of the radio-controlled car 12 is to be charged or the car is to be programmed with a different frequency, the radio-controlled car 12 is placed on the interface pad 90 of the transmitter 10 to engage the catches 92 and 94. By placing the radio-controlled car 12 on the interface pad 90, the charging button 112 of the transmitter 10 is activated, which begins the charging process of the radio-controlled car 12 via the electrical connection between the charging contacts 132 and 134 of the radio-controlled car 12 and the charging contacts 106 and 108 of the transmitter 10.

During charging, the operating frequency of the radio-controlled car 12 and the transmitter 10 may be modified by moving the channel selection switch 28 to a desired operating channel. The indicator 30 may emit a blinking red color to indicate channel frequency programming. Upon frequency selection, the indicator 30 may emit a steady red color to indicate charging. When the charging process is completed, the indicator 30 may emit a green color.

If channel programming fails, the indicator 30 may emit an amber color to indicate such failure. The user may then remove the radio-controlled car 12 from the transmitter 10 to clear the programming failure, and then reposition the radio-controlled car 12 on the transmitter 10 to restart the charging and programming operations.

When the selected operating frequency is programmed and the radio-controlled car 12 has been charged, the radio-controlled car 12 may be removed from the transmitter 10 by pressing the release button 38. Prior to controlling the radio-controlled car 12, the user may configure the transmitter 10 for right or left-handed use. For example, a right-handed user may move the left hand/right hand selection switch 36 to the "right" position, which configures the motion control member 40 to impart forward motion to the radio-controlled car 12 when the motion control member is moved in a left direction and to impart backward motion to the car when the motion control member is moved in a right direction. Generally, a right-handed user may control the steering member 32 using the left hand while manipulating the motion control member 40 with the right hand. If the alternative configuration is desired, the user may move the left hand/right hand selection switch 36 to the "left" position.

The radio-controlled car 12 may then be controlled by gripping the transmitter 10 and moving the steering member 32 and the motion control member 40. If the wheel alignment of the radio-controlled car 12 drifts during neutral steering, then the steering trimmer 64 and/or the steering adjuster 34 may be adjusted. Additionally, if the radio-controlled car 12 moves when the motion control member 40 is in a neutral position, the motion control trimmer 74 may be adjusted accordingly.

The present invention has been described relative to a preferred embodiment. Improvements or modifications that become apparent to persons of ordinary skill in the art after reading this disclosure are deemed within the spirit and scope of the application. For example, a variety of alternate circuit configurations and components may be used to achieve the functionality of the circuits described above. Furthermore, alternate controls may be provided that accomplish similar functions to those described herein. Still further, functionality such as adjustments to the steering and/or to the forward/backward motion may be automatically achieved via one of the microcontrollers housed within the transmitter 10 or the car 12. Accordingly, it is understood that several modifications, changes and substitutions are intended in the foregoing disclosure and, in some instances, some features of the invention will be employed without a corresponding use of other features. It is also understood that all spatial references, such as "right," "left," "longitudinal," "radial," "top," "side," "back," and "front" are for illustrative purposes only and can be varied within the scope of the disclosure. Accordingly, it is appropriate that the appended claims be construed broadly and in a manner consistent with the scope of the invention.

What is claimed is:

1. A transmitter for use in communicating with a radio-controlled toy, comprising:

a selector for selecting one of a plurality of radio frequency channels;

a charging circuit for charging a battery associated with at least one of the transmitter and the toy; and an interface for transferring a selected radio frequency channel from the transmitter to the toy, wherein the selected radio frequency channel is selected via the selector, and wherein the selected radio frequency channel is transferred from the transmitter to the toy while the battery is in communication with the charging circuit.

2. The transmitter of claim 1 further comprising a radio frequency channel selection circuit connected to the selector, wherein the radio frequency channel selection circuit provides an electrical representation of the selected radio frequency channel.

3. The transmitter of claim 2 further comprising a microcontroller unit, wherein the microcontroller unit identifies the selected radio frequency channel based on the electrical representation provided by the radio frequency channel selection circuit.

4. The transmitter of claim 3 wherein the interface is an electrical connection between the microcontroller unit and an electrical circuit housed within the toy.

5. The transmitter of claim 3 further comprising a signal transmission circuit, wherein the signal transmission circuit includes:

frequency control circuitry for controlling a transmitting frequency of the transmitter based on the selected radio frequency channel; and transmitting circuitry associated with the frequency control circuitry for transmitting data received from the microcontroller unit to the radio-controlled toy using the selected radio frequency channel.

6. The transmitter of claim 1 wherein the selected radio frequency channel is transferred from the transmitter to the toy while the battery is being charged.

7. The transmitter of claim 6 further comprising at least one light emitting diode (LED) for displaying an operational state of the transmitter.

8. The transmitter of claim 7 wherein the operational state indicates whether the transmitter is powered on, the battery of the toy is being charged via the charging circuit, the selected radio frequency channel is being transferred to the toy, or the transfer of the selected radio frequency channel to the toy has failed.

9. The transmitter of claim 8 wherein the operational state is represented by at least one of a color or a blinking/steady state of the LED.

10. A programmable frequency radio-controlled car comprising:

a battery;

an interface configured for charging the battery and for receiving a user-selected operating frequency from a transmitter while the battery is charging;

a controller for detecting the received operating frequency; and a memory accessible to the controller for storing the received operating frequency, wherein the stored operating frequency is used by the radio-controlled car for interpreting signals transmitted by the transmitter.

11. The radio-controlled car of claim 10 wherein the controller is a microcontroller unit.

12. The radio-controlled car of claim 11 further comprising a signal receiving circuit for receiving data in a signal transmitted by the transmitter, wherein the signal receiving circuit comprises:

circuitry for mixing the received signal down to an intermediate frequency based on the stored operating frequency; and circuitry for demodulating and shaping the intermediate frequency signal, so that the data in the signal transmitted by the transmitter can be recovered and provided to the microcontroller unit.

13. A system for selecting an operating frequency to be used for communication between a radio transmitter and a radio-controlled toy, the system comprising:

a radio transmitter having a frequency selector for selecting the operating frequency from a plurality of frequencies, and an interface for transferring the selected operating frequency to the radio-controlled toy; and a radio-controlled toy having an interface for receiving the selected operating frequency from the radio transmitter during charging of a battery associated with at least one of the radio transmitter and the radio-controlled toy, and a memory accessible to the interface for storing the received operating frequency.

14. The system of claim 13 wherein the transmitter further comprises a programmable signal transmitter for sending signals to the radio-controlled toy using the selected operating frequency.

15. The system of claim 13 wherein the radio-controlled toy further comprises:

a signal receiver for receiving signals from the transmitter; and a microcontroller unit accessible to the memory for configuring the signal receiver to operate using the stored operating frequency.

16. A transmitter for a radio-controlled toy, wherein the toy includes a programming contact and at least two charging contacts, the transmitter comprising:

a housing;

a frequency selection circuit positioned within the housing;

a charging circuit positioned within the housing;

an interface pad proximate to a surface of the housing, wherein the interface pad provides electrical communication between the frequency selection circuit and the programming contact of the toy to transfer frequency selection information from the frequency selection circuit to the toy, and wherein the interface pad further provides electrical communication between the charging circuit and the charging contacts of the toy; and a channel selection switch on the housing for selecting one of a plurality of predefined frequencies for the transmitter and the toy;

wherein the selected frequency is set as an operating frequency of the transmitter and toy during charging of the toy, and wherein the operating frequency is used for communications between the transmitter and toy.

17. The transmitter of claim 16 further comprising a multi-state indicator for indicating an on state, a frequency selection state, and a charging state.

18. The transmitter of claim 17 wherein the multi-state indicator is a light emitting diode.

19. The transmitter of claim 16 wherein the interface pad further comprises a charging button for activating the charging circuit.

20. The transmitter of claim 16 further comprising:

a transmitting circuit for transmitting data to the toy using one of the plurality of predefined frequencies; and a microcontroller unit for detecting the selected frequency and setting the transmitting circuit to use the selected frequency as the operating frequency for transmitting data.

* * * * *